US008662300B1

(12) United States Patent
Arena

(10) Patent No.: US 8,662,300 B1
(45) Date of Patent: Mar. 4, 2014

(54) SYSTEM AND METHOD FOR ATTACHING TOOLS TO A BUCKET

(76) Inventor: William Arena, Collegeville, PA (US)

( * ) Notice: Subject to any disclaimer, the term of this patent is extended or adjusted under 35 U.S.C. 154(b) by 958 days.

(21) Appl. No.: 11/581,272

(22) Filed: Oct. 16, 2006

(51) Int. Cl.
*B25H 3/00* (2006.01)

(52) U.S. Cl.
USPC ..... 206/373; 206/372

(58) Field of Classification Search
CPC ..... B25H 3/00; B65D 25/04; B65D 25/20
USPC ..... 206/372, 349, 373, 806, 234; 43/54.1; 150/161; 220/500, 23.83, 555, 735, 220/506, 625, 626, 630, 636, 638; 383/39; 439/501
See application file for complete search history.

(56) References Cited

U.S. PATENT DOCUMENTS

| | | | | | |
|---|---|---|---|---|---|
| 580,082 | A | * | 4/1897 | Ettenheimer | 220/650 |
| 973,029 | A | * | 10/1910 | Froese | 280/79.2 |
| 1,516,324 | A | * | 11/1924 | Bodde | 220/630 |
| 1,564,658 | A | * | 12/1925 | Xardell | 220/615 |
| 2,498,125 | A | * | 2/1950 | Knudsen et. al. | 366/325.4 |
| 2,760,675 | A | * | 8/1956 | George et al. | 220/561 |
| 2,789,723 | A | * | 4/1957 | Perez | 220/561 |
| 3,590,988 | A | * | 7/1971 | Hollar | 206/776 |
| 4,765,472 | A | * | 8/1988 | Dent | 206/373 |
| 4,925,026 | A | * | 5/1990 | McKay | 206/373 |
| 4,993,551 | A | * | 2/1991 | Lindsay | 206/373 |
| 5,103,977 | A | * | 4/1992 | Douglas | 206/702 |
| 5,117,724 | A | * | 6/1992 | Gardner | 84/421 |
| 5,125,183 | A | * | 6/1992 | Tisdell | 43/54.1 |
| 5,174,447 | A | * | 12/1992 | Fleming | 206/373 |
| 5,186,329 | A | * | 2/1993 | Fogelberg | 206/372 |
| D345,237 | S | * | 3/1994 | Stein | D32/53 |
| 5,437,369 | A | * | 8/1995 | Spitere | 206/373 |
| 5,587,862 | A | * | 12/1996 | Frank, Sr. | 361/42 |
| D388,919 | S | * | 1/1998 | Maire et al. | D32/53 |
| 5,848,701 | A | * | 12/1998 | Riccabona | 206/702 |
| 5,915,641 | A | * | 6/1999 | Barberg | 242/395.1 |
| 6,138,827 | A | * | 10/2000 | Marshall | 206/373 |
| 6,510,743 | B2 | * | 1/2003 | McAfee et al. | 73/803 |
| 6,536,590 | B1 | * | 3/2003 | Godshaw et al. | 206/373 |
| 6,968,955 | B2 | * | 11/2005 | Steeber | 206/702 |
| 7,077,693 | B1 | * | 7/2006 | Symons | 439/501 |
| 7,293,734 | B1 | * | 11/2007 | Kantner et al. | 242/395.1 |
| 2002/0003098 | A1 | * | 1/2002 | Bell | 206/373 |
| 2002/0088729 | A1 | * | 7/2002 | Urbanski | 206/373 |
| 2002/0130133 | A1 | * | 9/2002 | Immerman et al. | 220/630 |
| 2005/0056557 | A1 | * | 3/2005 | Jennings et al. | 206/349 |
| 2006/0144732 | A1 | * | 7/2006 | Kaplan et al. | 206/349 |
| 2006/0277813 | A1 | * | 12/2006 | Saldana | 43/21.2 |
| 2008/0023358 | A1 | * | 1/2008 | Otto | 206/349 |

* cited by examiner

*Primary Examiner* — J. Gregory Pickett
*Assistant Examiner* — King M Chu
(74) *Attorney, Agent, or Firm* — Lamorte & Associates, P.C.

(57) ABSTRACT

A tool holding assembly and the corresponding method of converting a bucket into a tool holding assembly. A standard bucket is provided having a flat base, a top rim and a peripheral wall that extends between the top rim and the flat base. The peripheral wall has an interior surface on the inside of the bucket and an exterior surface outside the bucket. At least one flexible plastic panel is provided. Each flexible panel has a front surface and a back surface. The front surface of each panel contains holding mechanisms for retaining tools. The back surface of each panel is flat and smooth. At least one flexible panel attaches to the peripheral wall of the bucket so that the back surface of the flexible plastic panel abuts against and conforms to the curvature of the bucket.

4 Claims, 3 Drawing Sheets

SYSTEM AND METHOD FOR ATTACHING TOOLS TO A BUCKET

BACKGROUND OF THE INVENTION

1. Field of the Invention

In general, the present invention relates to tool holders that are configured for buckets and pails. More particularly, the present invention relates to tool holders that attach to the interior and/or exterior surfaces of a bucket.

2. Prior Art Description

Many tradesmen and handymen carry tools in buckets and pails. This is especially true if the tradesman or handyman is attempting a job that needs the use of a bucket in addition to the tools the bucket carries.

There are some problems that are inherent to carrying tools in a bucket. One such problem is tool access. When tools are placed in a bucket, the tools either lay flat in the bucket or lean against the sides of the bucket. Most buckets are narrow. Accordingly, if many tools are placed in a bucket, the tools pile up and intertangle within the confines of the bucket. This makes it difficult to locate any one specific tool. Often, the entire contents of a bucket must be dumped before a tool, especially a small tool, can be located.

Another problem associated with carrying tools in buckets is one of tool protection. Water and debris tends to collect in the bottom of a bucket. This accumulation may not be noticed due to the tools piled in the bucket. If tools at the bottom of the bucket lay in water, they quickly rust. Depending upon the degree of rust experienced by a tool, a tool can become permanently damaged.

Recognizing the disadvantages of carrying tools loosely in a bucket, organizers have been developed that hold tools in an organized fashion within a bucket. Some organizers hold tools inside the confines of a bucket. Such prior art organizers are exemplified by U.S. Pat. No. 5,186,329 to Fogelberg, entitled Portable Tool Holder. Some organizers are designed to hold tools on the outside of a bucket. Such prior art tool holders are exemplified by U.S. Pat. No. 4,765,472 to Dent, entitled Bucket Attachment Tool Holder. Additionally, organizers have been developed that flop over the brim of a bucket to hold tools both on the inside of the bucket and on the outside of the bucket. Such prior art organizers are exemplified by U.S. Pat. No. 4,993,551 to Lindsay, entitled Tool Holder For Bucket.

A drawback of prior art bucket organizers is that they are sized to fit only one type of bucket, usually a five gallon utility bucket. However, buckets, even five gallon buckets, come in a wide variety of shapes and sizes. If a user has an organizer that is incompatible with the bucket they want to use, the organizer will either be stretched or buckled and will not work properly. Another drawback of prior art bucket tool organizers is that the organizer itself is commonly made of canvas or another woven material. This provides the organizer with the flexibility it needs to curve around the periphery of a bucket. However, many tools held by such organizers have sharp edges. These sharp edges can easily cut, snag and tear woven fabric, thereby causing damage to the tool organizer. Woven fabric also has a tendency to hold moisture. Thus, if a prior art tool organizer gets wet, it will hold moisture for a long period of time. This can cause mold on the organizer itself and rust to all the tools in contact with the wet fabric.

A need therefore exists for a bucket tool organizer that can be used on a wide range of bucket sizes with equal effectiveness. A need also exists for a bucket tool organizer that is not fabric and does not retain moisture. These needs are met by the present invention as described and claimed below.

SUMMARY OF THE INVENTION

The present invention is a tool holding assembly and the corresponding method of converting a bucket into a tool holding assembly. A standard bucket is provided. Accordingly, the bucket has a flat base, a top rim and a peripheral wall that extends between the top rim and the flat base. The peripheral wall has an interior surface on the inside of the bucket and an exterior surface outside the bucket.

At least one flexible plastic panel is provided. Each flexible panel has a front surface and a back surface. The front surface of each panel contains holding mechanisms for retaining tools. The back surface of each panel is flat and smooth.

At least one flexible panel attaches to the peripheral wall of the bucket so that the back surface of the flexible plastic panel abuts against and conforms to the curvature of the bucket. Selectively, the flexible panels can be attached to the interior surface of the bucket's peripheral wall and/or its exterior surface.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention can be used to attach tools to many types of containers, such as tool boxes, coolers, wagons and the like, the present invention is particularly well suited for attaching tools to a bucket. Accordingly, by way of example, the present invention is illustrated in an application where it is being applied to a bucket in order to set forth the best mode contemplated for the invention.

Figure 1:
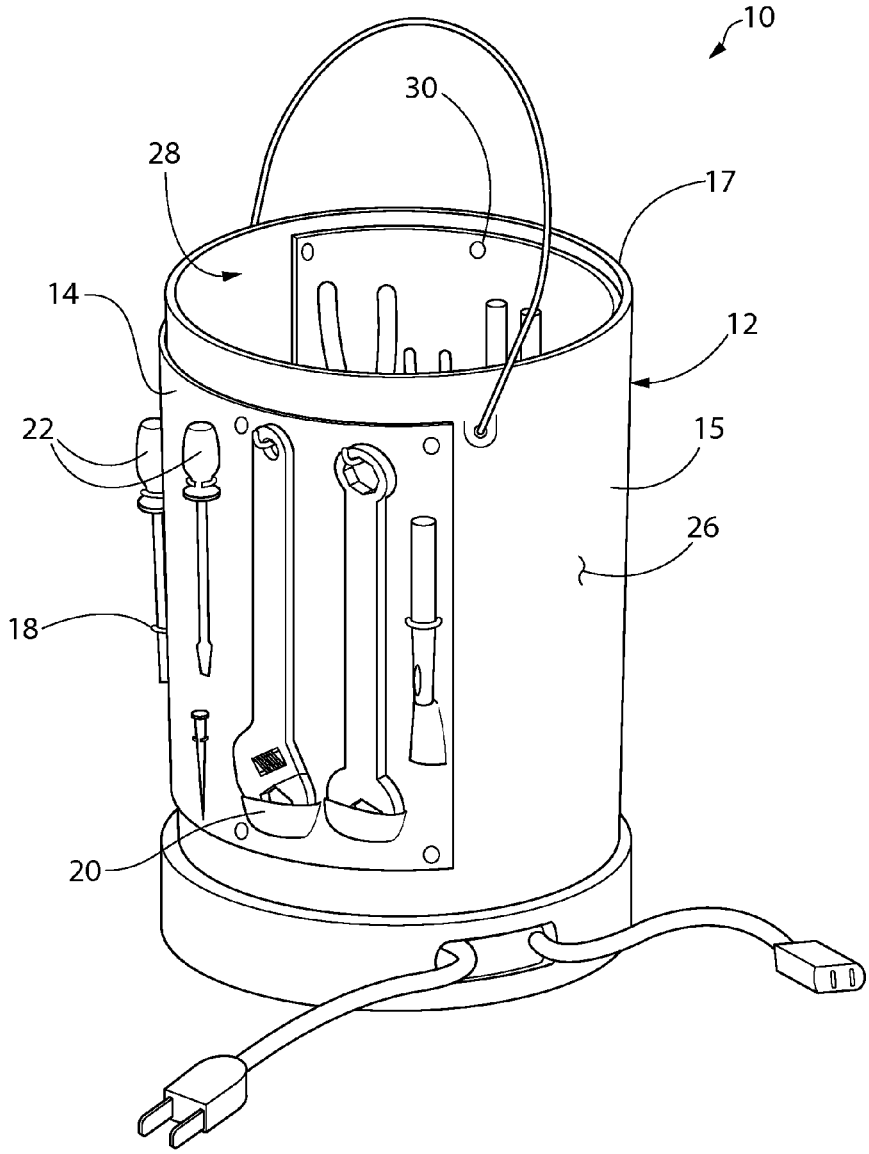
FIG. 1 is perspective view of an exemplary embodiment of the present invention tool holding assembly.
Figure 2:
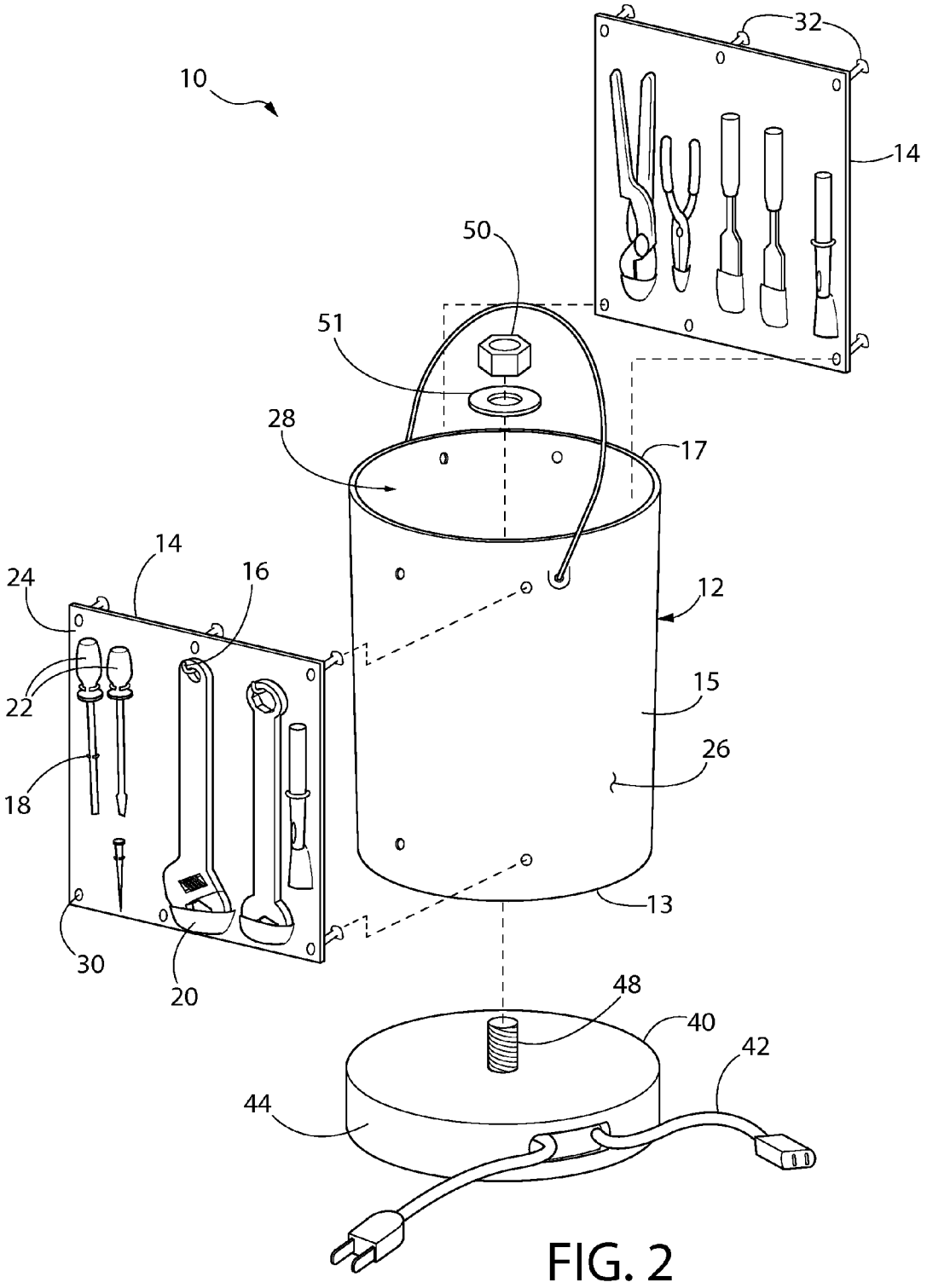
FIG. 2 is an exploded view of the embodiment of FIG. 1.

Referring to Both FIG. 1 and FIG. 2, a tool bucket assembly 10 is shown. The tool bucket assembly 10 is comprised of a standard prior art bucket 12. Accordingly, the bucket 12 has a flat bottom 13 and a peripheral wall 15 that extends upwardly from the flat bottom 13 to an open top rim 17. The bucket 12 can be any size, as will later be explained. A series of flexible panels 14 are provided. Each of the flexible panels 14 contains hooks 16, clips 18 and/or receptacles 20 that are interpositioned to hold a wide selection of tools 22. Each of the flexible panels 14 has a flat back plate 24 molded from a flexible plastic. Accordingly, the normally flat back plate 24 can be selectively bent into a variety of curvatures. The bucket 12 has an exterior surface 26 with a first radius of curvature and an interior surface 28 with a slightly smaller radius of curvature. It will be understood that the back plate 24 of any panel 14 can be bent to match the curvature of either surface.

The various flexible panels 14 have mounting points 30. The flexible panels 14 are directly mounted to either the interior surface 28 of the bucket 12 or the exterior surface 26 of the bucket 12 using either screws, bolts or some similar mechanical fastener 32. It will therefore be understood that a user can selectively add flexible panels to both the inside and the outside of the bucket 12 as needed. The flexible panels 14 can completely encircle the bucket 12 or may just be located on one side of the bucket 12. However, once attached, the panels 14 are set into fixed positions on the bucket 12 and will not move.

Figure 3:
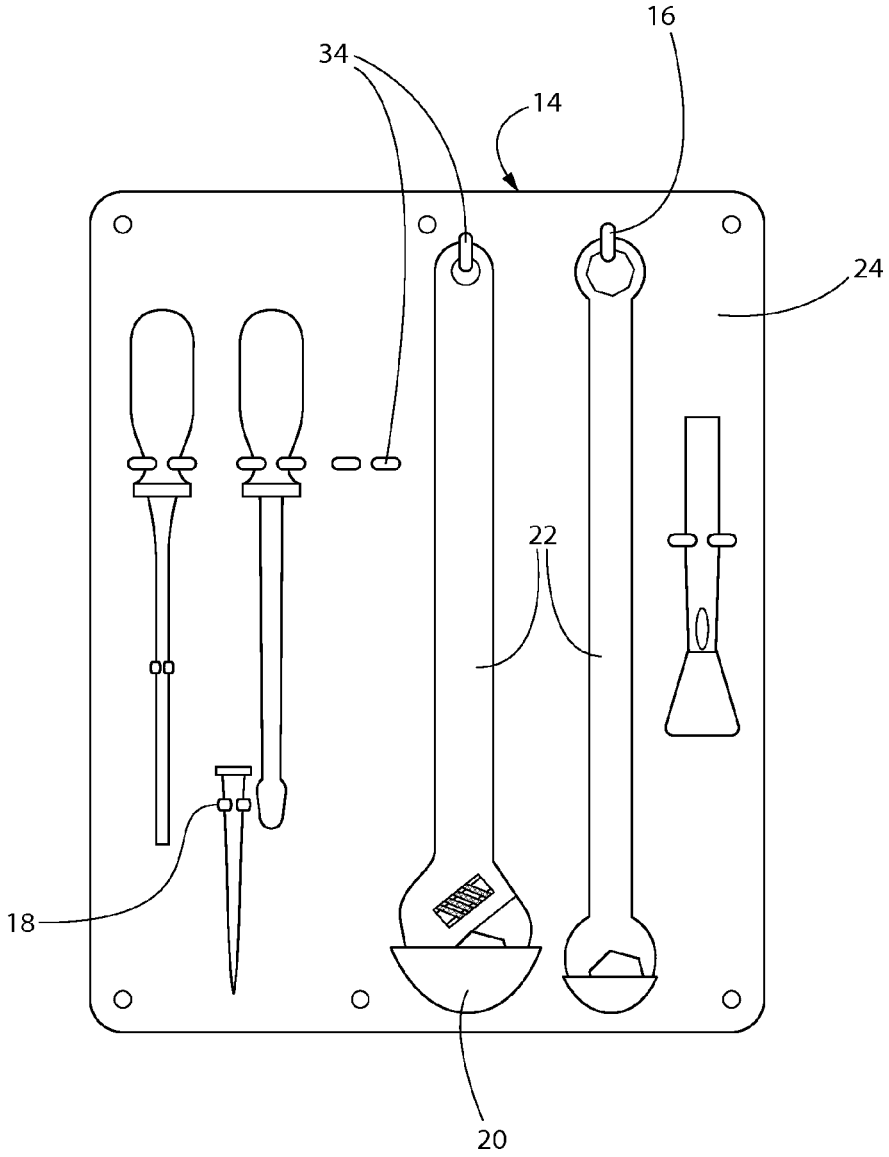
FIG. 3 is a front view of a flexible panel used in the tool holding assembly.

Referring now to FIG. 3, an exemplary embodiment of a flexible panel 14 is shown. The flexible panel 14 has many types of holding mechanisms 34 for different types of tools 22. The number, size and position of those holding mechanisms 34 are a matter of design choice. In the exemplary embodiment of the flexible panel 14, a variety of different holding mechanisms are illustrated. For small items, such as pencils, driving bits, screwdrivers and the like, small clips 18 are provided. The clips 18 can be metal, but are preferably molded into the plastic structure of the flexible panel 14. Accordingly, the clips 18 and back plate 24 are integral parts of a common molding.

For larger tools, such as wrenches, hammers and the like, a base receptacle 20 is provided. The base receptacle 20 is a molded pocket that extends outwardly from the back plate 24. The base receptacle 20 receives the head of a tool 22. This prevents the head of the tool 22 from moving and bears much of the weight of the tool 22. The tops of the tools 22 are connected either to hooks 16 and/or clips 18 that extend outwardly from the back plate 24. Again, it is preferred that the base receptacles 20 and hooks 16 be integrally molded with the back plate 24.

It will be understood that different flexible panels can be made with themes to accommodate different types of tools. For example, a flexible panel for an auto mechanic would have holding mechanisms configured to hold a full line of box wrenches. A flexible panel for a plumber would be designed to hold monkey wrenches, offset wrenches and the like. A flexible panel for a carpenter will be designed to hold chisels, rasps, and the like. It will therefore be understood that a user can purchase different flexible panels depending upon the needs and tools owned by that user.

Referring back to FIG. 2, it can be seen that the tool bucket assembly 10 may also include an auxiliary base 40. The auxiliary base 40 can have the same diameter as the bottom of the bucket 12. However, it is preferred that the auxiliary base 40 be wider than the base of the tool bucket assembly 10. This makes the tool bucket assembly 10 more stable and unlikely to tip. This is especially important if an abundance of heavy tools 22 are supported high in the tool bucket assembly 10 by the various flexible panels, thereby raising the center of gravity of the tool bucket assembly 10.

The auxiliary base 40 is used to retain an extension cord 42. The auxiliary base 40 is a housing 44 for a spool 46 upon which the extension cord 42 is wound. A threaded shaft 48 extends upwardly from the center of the housing 44. To attach the housing 44 to the flat bottom 13 of the bucket 12, a hole is drilled in the bottom of the bucket 12. The threaded shaft 48 is passed through the hole in the bucket 12 and is attached to the bucket on the inside with a nut 50 and washer 51.

It will be understood that the embodiment of the present invention that is illustrated is merely exemplary and that a person skilled in the art can make many modifications to the shown embodiment. For instance, in the shown embodiment, the flexible panels have a square back plate. Square back plates work well in buckets that are cylindrical in shape. However, if a bucket is tapered, a trapezoidal back plate would conform to the bucket better than a square back plate. It should therefore be understood that the shape of the back plate can be changed. All such variations, modifications and alternate embodiments are intended to be included within the scope of the present invention as defined by the appended claims.

What is claimed is:

1. A method of converting a bucket into a tool holding assembly, said method comprising the steps of:

providing a bucket having a flat base, a top rim and a curved peripheral wall that extends between said top rim and said flat base, wherein said curved peripheral wall has an interior surface and an exterior surface;

providing at least two separate and distinct panels, each of said panels having a molded plastic back plate with a front surface and a flat back surface, wherein each said front surface contains multiple holding mechanisms for retaining tools;

attaching each said back plate directly to said curved peripheral wall of said bucket so that said flat back surface of each said back plate abuts against and conforms to said curved peripheral wall of said bucket without touching another of said panels.

2. The method according to claim 1, wherein said step of attaching each said back plate includes attaching said panels to both said interior surface and said exterior surface of said peripheral wall of said bucket.

3. The method according to claim 1, further including the step of attaching an auxiliary base to said flat base of said bucket.

4. The method according to claim 3, wherein said auxiliary base contains an extension cord.

* * * * *